US006705414B2

(12) United States Patent
Simpson et al.

(10) Patent No.: US 6,705,414 B2
(45) Date of Patent: Mar. 16, 2004

(54) TUBULAR TRANSFER SYSTEM

(75) Inventors: Michael Simpson, Aberdeen (GB); Colin James Davidson, Aberdeen (GB)

(73) Assignee: GlobalSantaFe Corporation, Dallas, TX (US)

( * ) Notice: Subject to any disclaimer, the term of this patent is extended or adjusted under 35 U.S.C. 154(b) by 26 days.

(21) Appl. No.: 10/081,367

(22) Filed: Feb. 22, 2002

(65) Prior Publication Data

US 2003/0159854 A1 Aug. 28, 2003

(51) Int. Cl.[7] ..... C21B 19/20

(52) U.S. Cl. ..... 175/52; 175/85; 414/22.54; 414/22.61; 414/22.62

(58) Field of Search ..... 175/52, 57, 85, 175/162, 220; 414/22.54, 22.58, 22.61–22.63

(56) References Cited

U.S. PATENT DOCUMENTS

| | | | | |
|---|---|---|---|---|
| 3,633,771 A | | 1/1972 | Woolslayer et al. | |
| 4,382,591 A | * | 5/1983 | Minnis et al. | 269/156 |
| 4,492,270 A | | 1/1985 | Horton | |
| 4,493,593 A | | 1/1985 | Schlimbach | |
| 4,583,881 A | | 4/1986 | Steele | |
| 4,610,315 A | * | 9/1986 | Koga et al. | 175/85 |
| 4,658,903 A | | 4/1987 | Tateishi | |
| 4,759,414 A | | 7/1988 | Willis | |
| 4,822,230 A | | 4/1989 | Slettedal | |
| 4,854,400 A | * | 8/1989 | Simpson | 175/85 |
| 4,938,628 A | | 7/1990 | Ingle | |
| 5,037,241 A | | 8/1991 | Vaughn et al. | |
| 5,407,302 A | | 4/1995 | Springett et al. | |
| 5,447,391 A | | 9/1995 | Gallaher et al. | |
| 5,551,802 A | | 9/1996 | Wybro | |
| 5,553,977 A | | 9/1996 | Andersen et al. | |
| 5,593,250 A | | 1/1997 | Smith et al. | |
| 5,741,089 A | | 4/1998 | Gallaher et al. | |
| 5,855,455 A | | 1/1999 | Williford et al. | |
| 5,964,550 A | | 10/1999 | Blandford et al. | |
| 6,030,148 A | | 2/2000 | Tormala et al. | |
| 6,048,135 A | | 4/2000 | Williford et al. | |
| 6,073,699 A | | 6/2000 | Hollingsworth, Jr. | |
| 6,085,851 A | | 7/2000 | Scott et al. | |
| 6,149,350 A | | 11/2000 | Khachaturian | |
| 6,171,027 B1 | | 1/2001 | Blankestijin | |
| 6,220,807 B1 | | 4/2001 | Sorokan | |
| 6,609,573 B1 | * | 8/2003 | Day | 166/380 |

* cited by examiner

*Primary Examiner*—Zakiya Walker
(74) *Attorney, Agent, or Firm*—David W. Carstens; Carstens Yee & Cahoon, LLP

(57) ABSTRACT

A method and apparatus for transferring tubular stands between a substantially horizontal position on the catwalk and a substantially vertical position at the rig floor entry. In one embodiment of the invention, this is accomplished by moving bundles of individual tubulars to the process area, where a stand make-up/break-out machine, also called a bucking machine, makes up the tubular stands. The bucking machine aligns and stabs the connections and makes up the connection to the correct torque. The tubular stand is then transferred from the bucking machine to a stand storage area or to a trolley pick-up area. When additional stands are needed by the drilling operation, a trolley is moved into position over the trolley pick-up area to retrieve the stands previously placed in the trolley pick-up area. The stands are clamped to the trolley and the trolley is moved from a substantially horizontal position to a substantially vertical position at the rig floor entry. A vertical pipe-racking machine transfers the stands to the traveling equipment. The traveling equipment makes up the stand connection and the stand is run into the hole. The operation can also be reversed to remove stands from the rig floor entry and break out the stands in a horizontal position.

22 Claims, 13 Drawing Sheets

TUBULAR TRANSFER SYSTEM

BACKGROUND OF THE INVENTION

1. Technical Field

The present invention relates to a tubular transfer system for a drill rig, and in particular, to a tubular transfer system that moves the tubulars between a horizontal position on the deck and a vertical position at the rig floor entry.

2. Description of Related Art

Drill rigs have utilized several methods for transferring tubular members from a pipe rack adjacent to the drill floor to a mousehole in the drill floor or the well bore for connection to a previously transferred tubular or tubular string. The term "tubular" as used herein includes all forms of drill pipe, drill collars, casing, liner, bottom hole assemblies (BHA), and other types of tubulars known in the art. Conventionally, drill rigs have utilized a combination of the rig cranes and the traveling system for transferring a tubular from the pipe rack to a vertical position above the center of the well. The obvious disadvantage with the prior art systems is that there is a significant manual involvement in attaching the pipe elevators to the tubular and moving the pipe from the pipe rack to the rotary table. This manual transfer operation in the vicinity of workers is potentially dangerous and has caused numerous injuries in drilling operations. Further, the hoisting system may allow the tubular to come into contact with the catwalk or other portions of the rig as the tubular is transferred from the pipe rack to the drill floor. This can cause damage to the tubular and may affect the integrity of the connections between successive tubulars in the well. Finally, past systems have only been able to transfer single joints of pipe or casing.

In response to the disadvantages of a conventional handling system, other prior art apparatuses for gripping a drill pipe and transferring the pipe from a horizontal position on the pipe rack to a vertical position above the drill floor have been developed. Some of these systems allow the pipe to be handled without the necessity of manual interaction in grasping the pipe or transferring the pipe to the well. One of these apparatuses is disclosed in U.S. Pat. No. 3,633,771 to Woolslayer, et al. Woolslayer teaches a drill string that is moved by a strongback having hydraulic grasping jaws. This apparatus is mounted to the drilling platform and is centered in the V-door of the rig.

Another apparatus is disclosed in U.S. Pat. No. 4,834,604 to Brittian et al. Brittian teaches a strongback that is connected to a one piece boom with the boom being mounted on a base located adjacent the rig and operating directly through the V-door of the rig. The strongback transfers pipe through the V-door to a vertical position and raises or lowers the pipe so that a connection between the pipe and the drill string can occur.

Yet another apparatus is disclosed in U.S. Pat. No. 5,458,454 to Sorokan. Sorokan discloses a pipe handling method for moving tubulars from a horizontal position on a pipe rack adjacent to the well bore to a vertical position over the center of the well by using a bicep and forearm assembly and gripper head for attachment to a tubular. The tubular is moved along or close to the conventional path of the tubular utilizing known cable transfer techniques so as to allow access to the drill floor through the V-door of the rig. More recent designs have utilized a deck transfer system complete with a conveyer to move individual joints from the deck area to the rig floor entry.

The disadvantages of the prior art are several: a substantial amount of human physical contact with tubulars and lifting devices is required; the process for transferring tubulars is lengthy, costing more in rig time and total operational spread cost; the condition of a drilled hole deteriorates with time and may cause damage to the well; the space on the rig floor is limited, thus limiting the ability to conduct simultaneous operations such as drilling and picking up tubulars from the deck; and there are safety risks associated with a crane interface with the rig floor. All of the previous systems have only been able to pick up a single length of drill pipe, which is generally 30 feet long, or a single length of casing, which is generally 40 feet long.

Ideally, one would like to have a horizontal to vertical tubular transfer system that allows multiple segments of tubulars to be assembled on the deck, prior to being moved to the rig floor, then stored in a pipe rack until needed by the drilling operation. The system should minimize required manual contact with tubulars while maintaining the simplicity of the drilling operation. The tubular transfer system should also be relatively lightweight, and low-cost. The system should also increase the efficiency of the tubular handling operation.

SUMMARY OF THE INVENTION

The present invention is a method and apparatus for transferring tubular stands, which include more than one length of connected tubulars, between a substantially horizontal position on the catwalk and a substantially vertical position at the rig floor entry. In one embodiment of the invention, the drilling rig is a cantilever jack-up in which the cantilever beams are of sufficient length that three joints of Range II drill pipe (nominal 30 ft lengths) can be stored when assembled together; such a length of three drill pipes is normally called a stand. In this embodiment, individual joints of drill pipe are transferred from the main deck pipe racks to the cantilever pipe rack and then to a stand make-up/break-out machine, also called a bucking machine. The bucking machine stabs the drill pipe connections and makes them up to the correct torque. The drill pipe stand is then transferred from the bucking machine to a stand storage area (pipe rack) or to a trolley pick-up area. When additional stands are needed by the drilling operation, a trolley is moved into position over the trolley pick-up area to retrieve stands previously made up. The stands are clamped to the trolley and the trolley is moved from a substantially horizontal position to a substantially vertical position at the rig floor entry. A vertical pipe racking machine permanently located in the derrick transfers the stands to the well center where it can be picked up by the traveling equipment or to the vertical pipe rack in the derrick (or set back) where it can be stored until needed by the drilling operation. The stand is made up to the drill string already in the hole and the stand is run into the hole. This operation is repeated until all of the drill pipe required by the drilling operation has been installed in the hole. The operation can also be reversed to remove stands from the rig floor entry and break out the stands in a horizontal position on the cantilever pipe rack deck. The description above relates to drill pipe but exactly the same process can be applied to casing, which normally comes in 40 ft lengths and therefore a stand of casing in this embodiment will consist of two joints of pipe also made up by the bucking machine on the cantilever pipe rack deck.

BRIEF DESCRIPTION OF THE DRAWINGS

The novel features characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE INVENTION

Figure 1A:
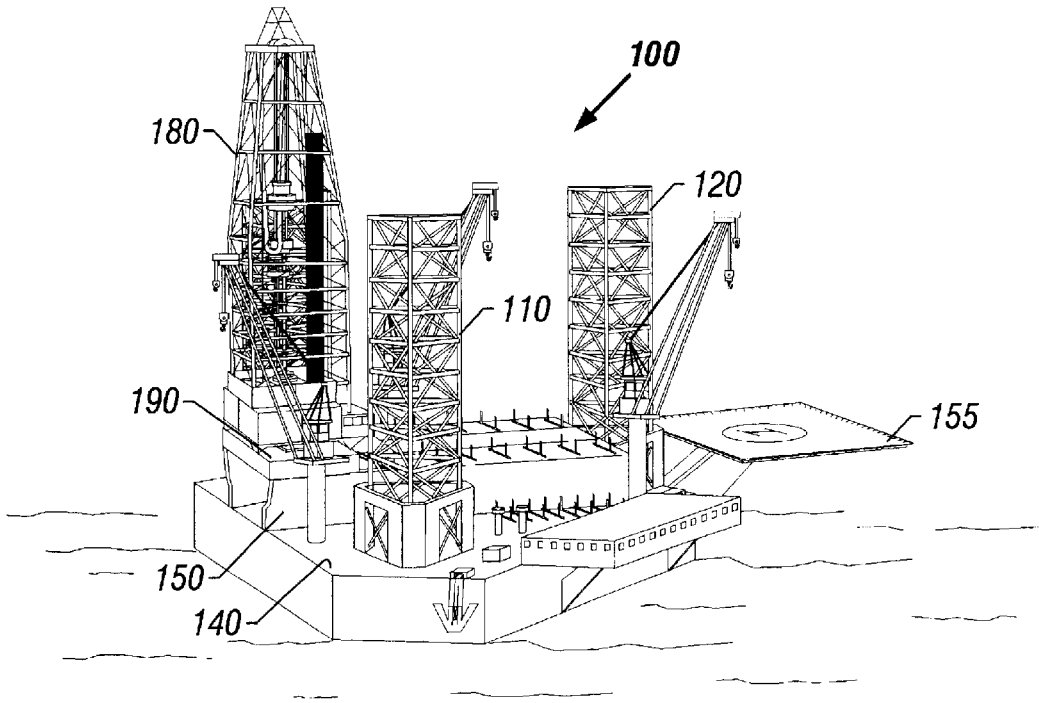
FIGS. 1A and 1B are perspective views of a jack-up rig in accordance with an embodiment of the invention.
Figure 1B:
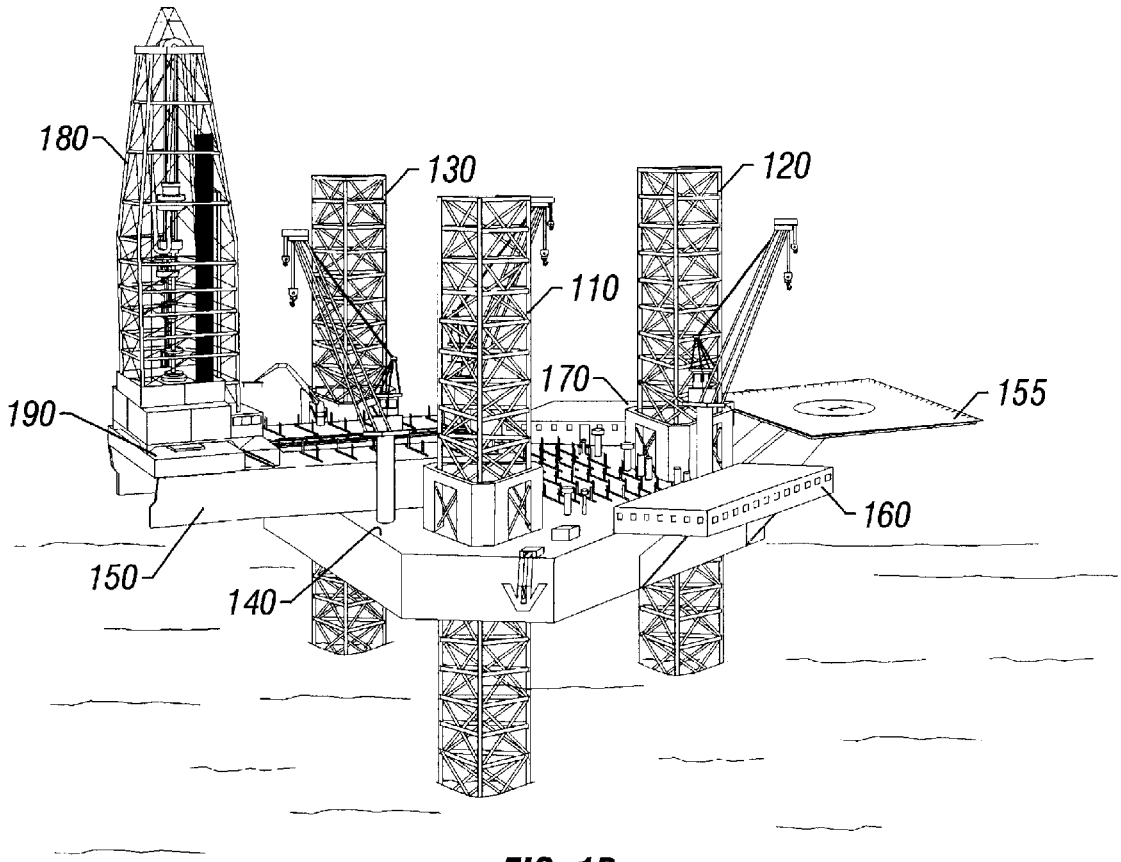

Referring now to FIGS. 1A and 1B, perspective views of a jack-up rig 100, in accordance with an embodiment of the invention, is illustrated. The jack-up rig in FIG. 1A is shown in a floating mode. The jack-up rig has independent legs 110, 120, 130 that are positioned in proximity to a respective corner of the triangular platform 140. The independent legs 110, 120, 130 are extended through the platform 140 to the floor of the body of water over which the platform is located. Once the independent legs 110, 120, 130 have made contact with the floor, the platform 140 can then be "jacked-up" above the surface of the water. This method of jacking-up the platform is well known in the art. While the invention is described in regard to an off-shore jack-up rig, the invention is not limited to any particular type of drilling rig, nor is it limited to drilling rigs in particular. The invention may be used anywhere a tubular transfer system is needed without departing from the scope of the invention. For example, the invention may be used for land rigs, production and drilling platforms, tender assist rigs, and drilling barges.

Once the platform 140 has been jacked-up, the cantilever 150 can be extended out over the water as shown in FIG. 1B. The upper surface of the platform 140 supports a helipad 155, and living quarters 160, 170. The cantilever comprises two beams 150 which support at their aft end a substructure on which is mounted the drill floor. In the presently preferred embodiment, the drill floor is capable of lateral movement on the substructure. The cantilever is extended and the drill floor is moved laterally on the substructure so that the rotary table can be placed in a precisely pre-selected location aft of the jack-up hull transom. In an alternative embodiment the drill floor remains stationary on the substructure and the entire cantilever is moved laterally. In the current design, the living quarters were mounted to the sides of the bow leg, rather than being positioned aft, as they are in previous designs. This change allowed the cantilever to extend all of the way forward to the bow leg when in the stowed position. As result it is much longer than prior art cantilevers which terminated at the aft side of the quarters house. This increased cantilever length also increased the cantilever pipe rack length to more than the 90 feet required to accommodate a stand of three connected drill pipes. Prior art cantilever pipe racks generally are not long enough to accommodate a stand of drill pipe. This increased cantilever pipe rack length pointed to a need to be able to move assembled stands of pipe or casing from a horizontal position on the cantilever pipe rack to a vertical position at the vee door entrance.

Figure 2:
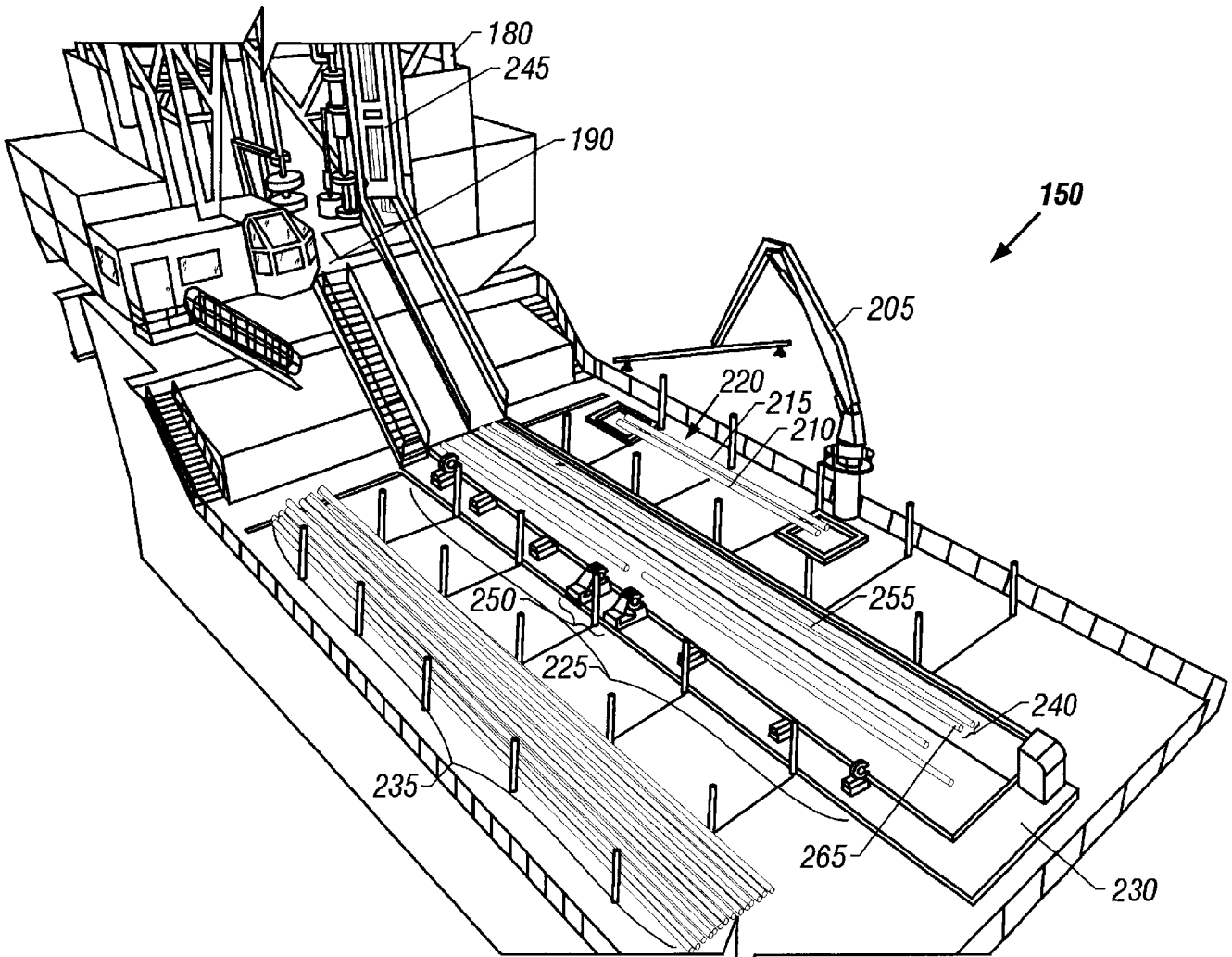
FIG. 2 is a perspective view of the cantilever and vee-door of FIGS. 1A and 1B in accordance with an embodiment of the invention.

Referring now to FIG. 2, a cut away perspective view of the cantilever 150 of FIGS. 1A and 1B in accordance with an embodiment of the invention is illustrated. A deck or rig crane 205 is used to place single pieces of drill pipe or casing called "tubulars" 210, 215 in the cantilever staging area 220. Once the individual tubulars have been prepared for make-up, the deck or rig crane 205 transfers the tubulars 210, 215 to the bucking machine 225 for assembly of the tubulars into a stand. In this embodiment, the bucking machine 225 is located on the catwalk 230. The bucking machine 225 aligns, stabs, and makes up the connection to the correct torque value. After make-up, the stand is transferred from the bucking machine 225 to a stand storage area 235 on the cantilever pipe rack 150 using the deck or rig crane 205. Alternatively, the stand could be placed directly into the trolley pick-up area 240 to be picked-up by the trolley 245.

All of the stands that will be needed for a section can be made-up prior to the drilling operation or the make-up process can be ongoing while the drilling operation is being conducted. By making-up the tubulars into stands before they are needed by the drilling operation, the process for make-up of the stands is taken out of the critical path of the drilling operation. Because the number of make-ups is reduced by making up the stands prior to the drilling operation, the time required to run the stands into the hole is reduced. Depending on the length of the cantilever 150, as well as the length of the tubulars 210, 215 double, treble, or more sections of tubulars can be made up in the horizontal position before being transferred to the derrick 180. The terms "horizontal" and vertical" as used herein are intended to encompass minor variations from perfectly horizontal and perfectly vertical, respectively. One with skill in the art will understand that these terms refer to approximate positions relative particular components of the drill rig.

The length of the cantilever 150, as well as the height of the derrick 180 can be varied depending on the length of the stands 255, 260 desired. In one embodiment of the invention, the dimensions of the cantilever 150 and the derrick 180 are such that a stand of approximately 90 feet can be accommodated and made up on the cantilever in the horizontal position and then transported to a vertical position in the derrick 180 in. A pair of power tongs 250 are utilized by the bucking machine 225 to make-up or break-out a tubular stand. These power tongs 250 are commonly known in the art.

Figure 3:
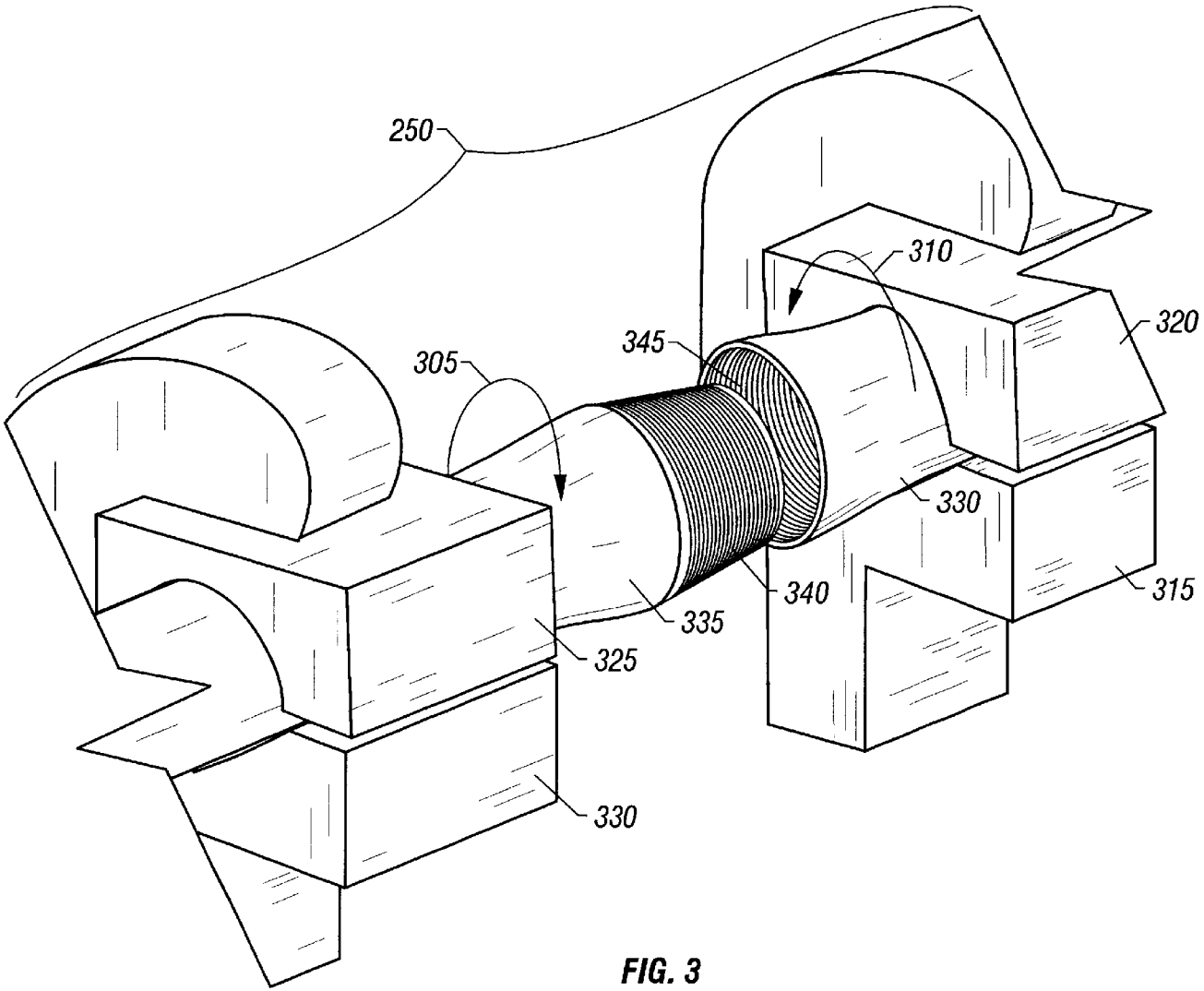
FIG. 3 is a cut away perspective view of the power tongs on the bucking machine shown in FIG. 2 in accordance with an embodiment of the invention.

Referring now to FIG. 3, a cut away perspective view of the power tongs 250 shown in FIG. 2 in accordance with an embodiment of the invention is illustrated. The jaws 315, 320, 325, 330 clamp down on the tubulars 330, 335 to mate the male end 340 of tubular 335 with the female end 345 of tubular 330. The jaws turn the tubulars in the direction of the arrows 305, 310 to screw the tubulars 330, 335 together and torque them to the appropriate value. The process can be reversed to break out the connection.

Figure 4A:
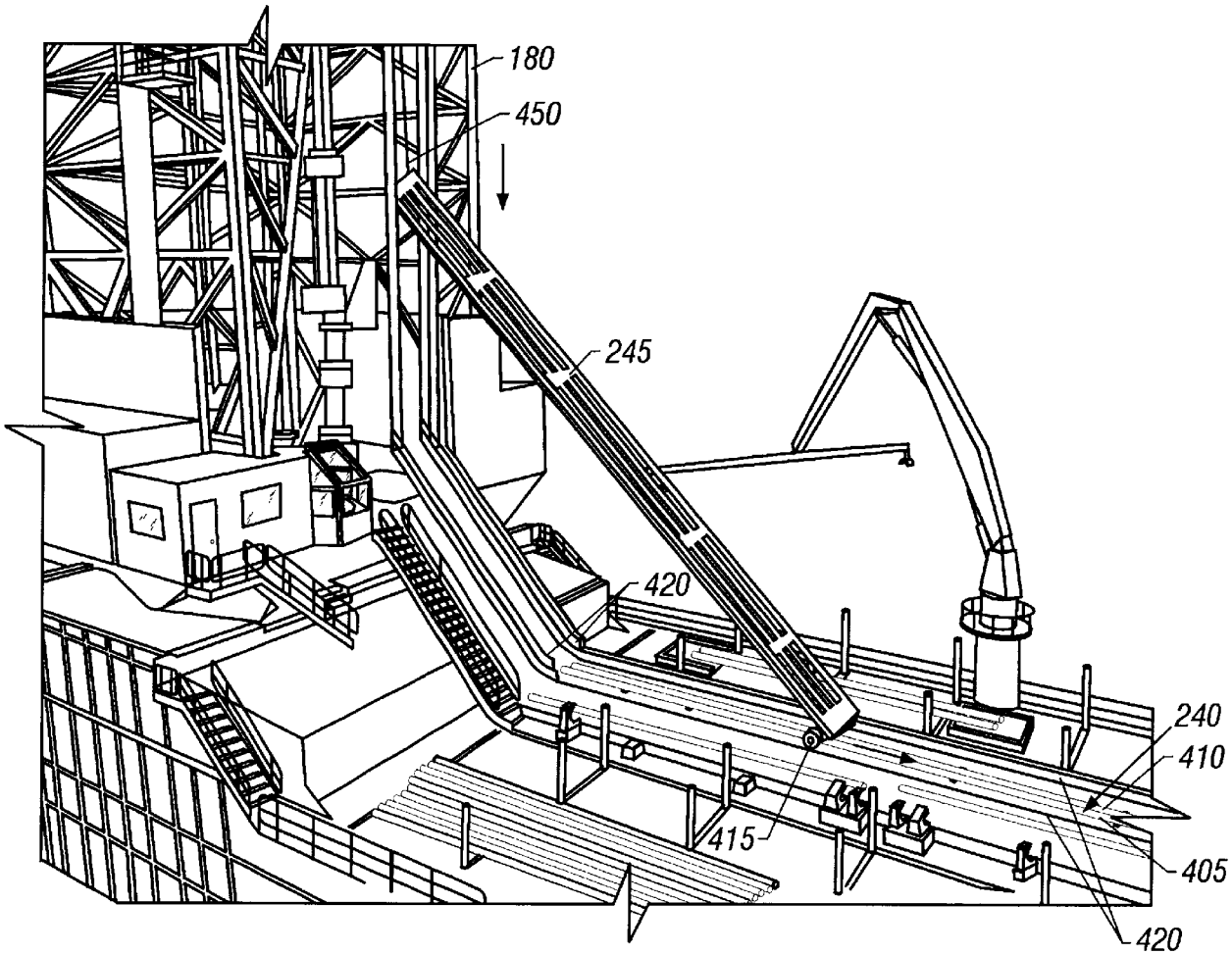
FIG. 4A is a perspective view of the cantilever with the trolley in a half-way-down position in accordance with an embodiment of the invention.

Referring now to FIG. 4A, a perspective view illustrates the cantilever with the trolley 245 in a halfway down position in accordance with an embodiment of the invention. Two tubular stands 405, 410 are placed in the trolley pick-up area 240 prior to the trolley 245 traveling down to the horizontal position. At the lower and upper ends of the trolley 245, a pair of wheels 415 are attached. The wheels 415 travel along a track 420 that extends from the lower end of the trolley travel on the cantilever 150 to the upper end of trolley travel on the derrick 180. The trolley 245 is attached to a drive means such as a cable winch 450 that is used to winch the trolley 245 up and down. The cable winch 450 could also be any drive means capable of moving the trolley 245 along the track 420 and is not limited to a cable winch. For example, the drive means could be a rack and pinion or a sliding mechanism in the track 420 that engages the trolley 245 to move it up and down.

Figure 4B:
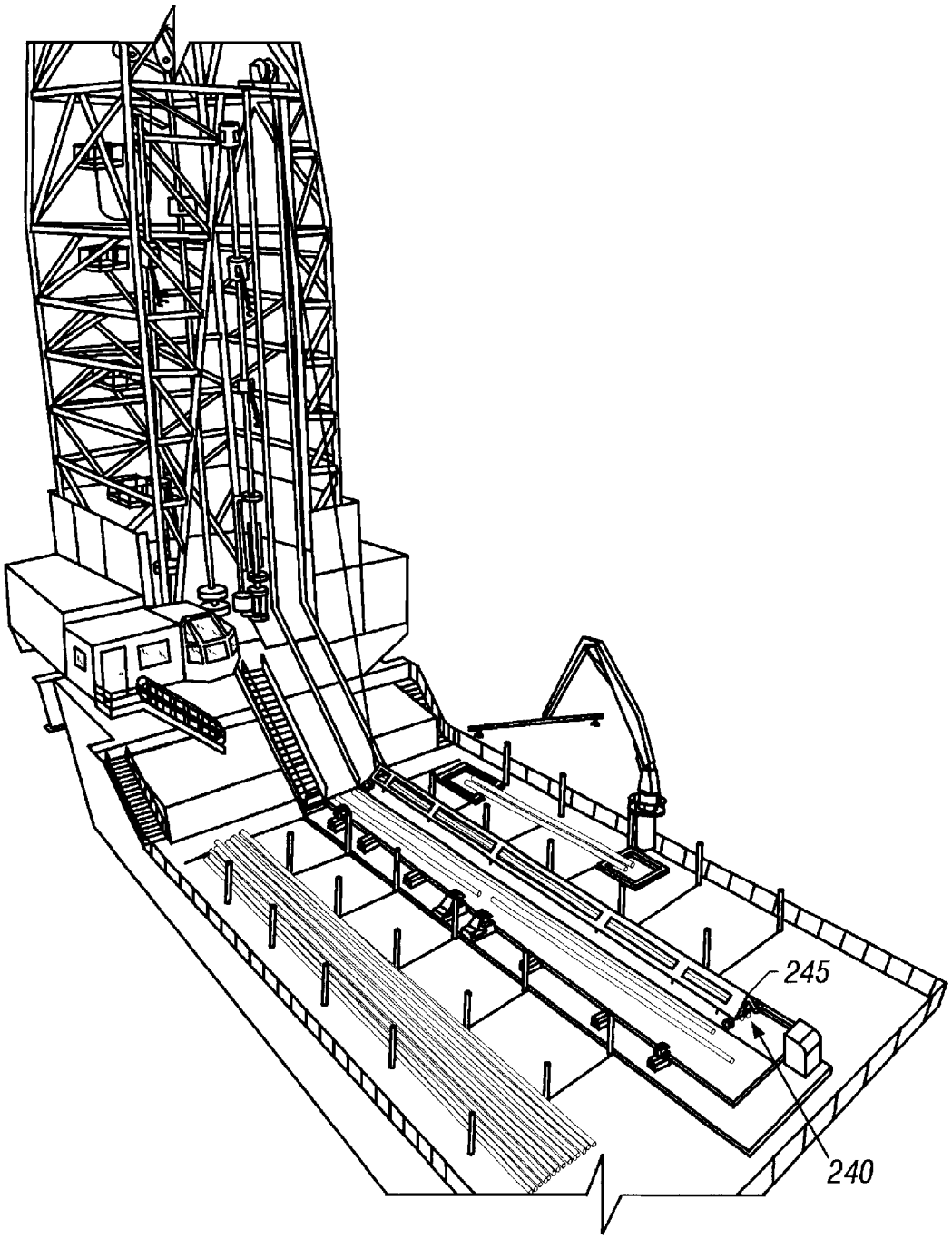
FIG. 4B is a perspective view of the cantilever with the trolley lowered to the horizontal position in accordance with an embodiment of the invention.

Referring now to FIG. 4B, a perspective view illustrates the cantilever with the trolley 245 lowered to the horizontal position in accordance with an embodiment of the invention. In the position shown, the trolley can pick up stands of tubulars from the trolley pick-up area 240. The number of stands picked up can vary depending on the design of the trolley 245. For example, with relatively small diameter tubulars, a higher number of stands may be picked up, and for relatively large diameter tubulars, a smaller number of stands may be picked up. One with skill in the art will recognize that any number of stands may be picked up at any given time without departing from the scope and spirit of the invention.

Figure 4D:
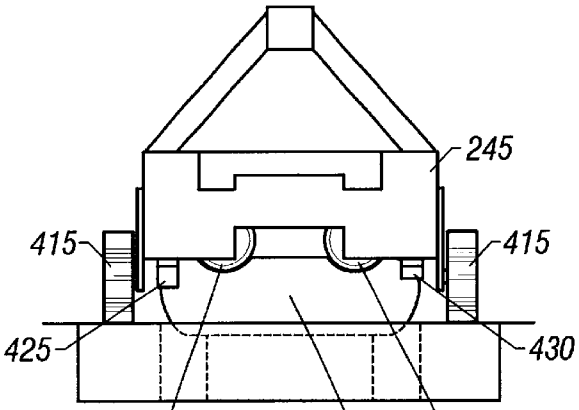
FIGS. 4C, 4D, 4E and 4F are end views of the trolley in the various states of a pick-up operation in accordance with an embodiment of the invention.
Figure 4C:
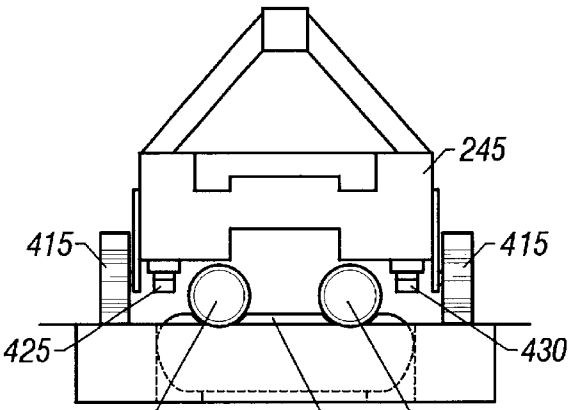
Figure 4F:
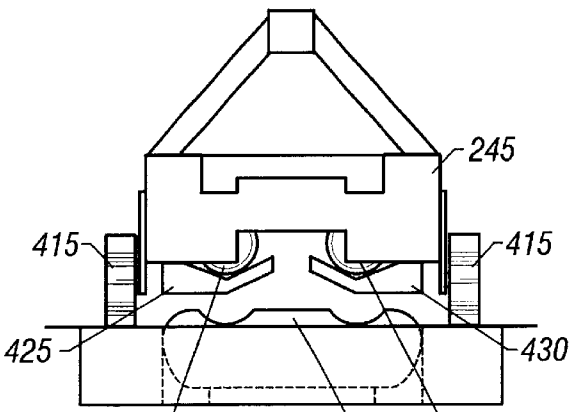
Figure 4E:
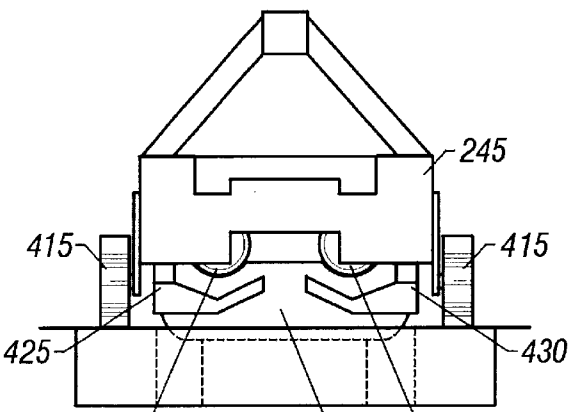

Referring now to FIGS. 4C, 4D, 4E and 4F, these drawings illustrate end views of the trolley 245 in the various states of a pick-up operation in accordance with an embodiment of the invention. In FIG. 4C, the trolley 245 is shown in the horizontal position as the pick up of the tubular stands 405, 410 begins. Before the trolley 245 is lowered to the horizontal position, the tubular stands 405, 410 are placed in the trolley pick up area such that they nest in a cut away in the push-up arms 435. Push-up arms 435 are located at a plurality of locations along the length of the tubular stands 405, 410 for pushing the tubular stands 405, 410 up into the trolley 245. FIG. 4D shows the tubular stands 405, 410 as they are pushed up into the trolley 245. At this point in the operation, the fingers 425, 430 are still in a retracted position. Once the tubulars have been pressed into place by the push-up arms 435, the fingers 425, 430 extend downward and swing inward from the stored position as shown in FIG. 4E. Once the fingers 425, 430 are under the tubulars as shown in FIG. 4E, the fingers 425, 430 are then lifted up to hold the tubulars 405, 410 in position on the trolley 245 and the push-up arms are lowered as shown in FIG. 4F. Once the tubular stands 405, 410 are clamped into place by the fingers 425, 430 on the trolley 245, the cable 450 is hoisted in an upward direction such that the trolley 245 moves along the track going first up the incline 440 (illustrated in FIG. 4G) such that the trolley 245 is transferred from a substantially horizontal position at the trolley pick up area into a substantially vertical position in the derrick 180.

The shape and structure of the trolley 245 has been disclosed and described in reference to FIGS. 4C, 4D, 4E, and 4F. However, the trolley is not required to have the structure disclosed. Any trolley capable of retrieving a tubular and moving along a track may be used. The particular grasping means disclosed can also be varied without departing from the scope of the invention.

Figure 4G:
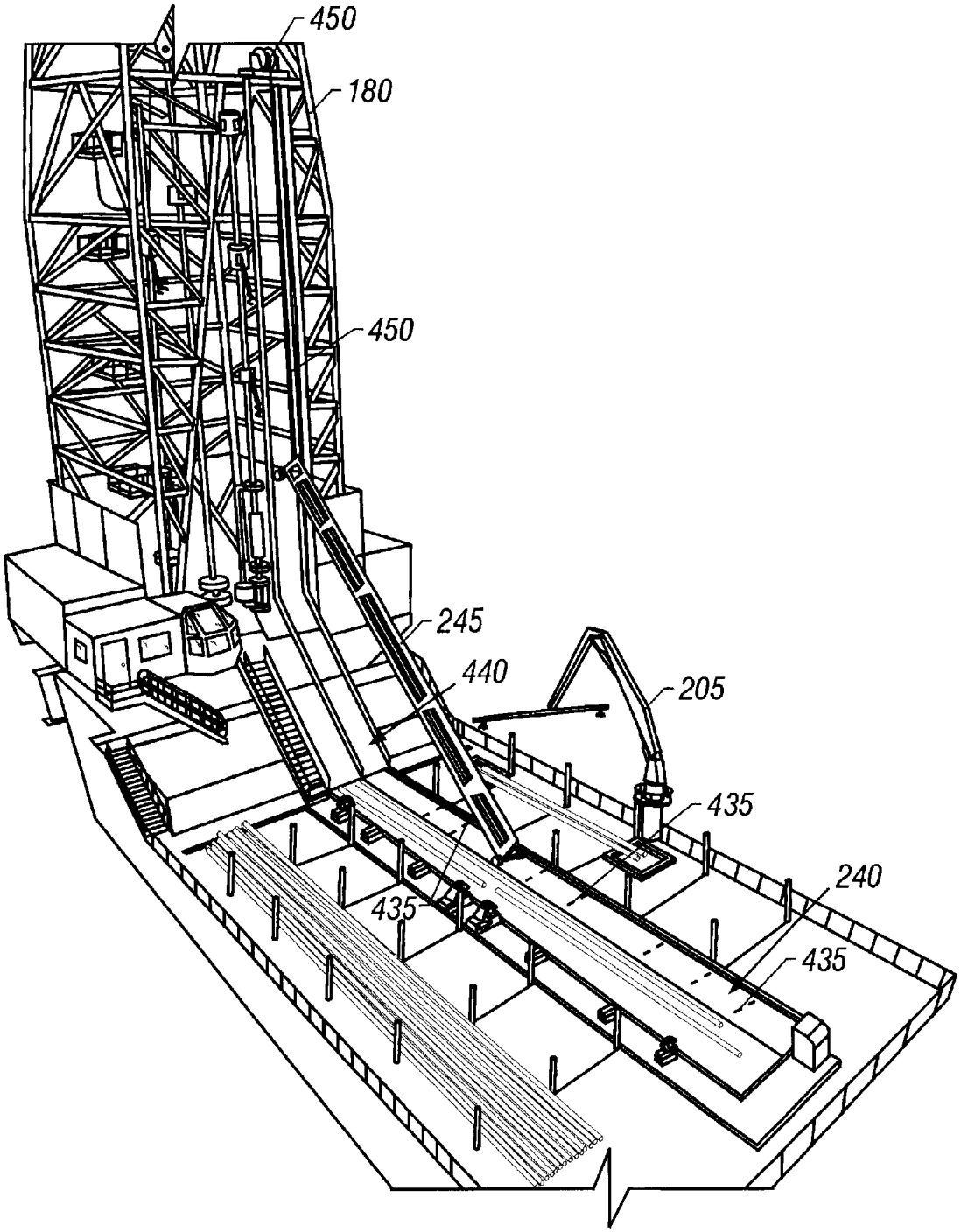
FIG. 4G is a perspective view of the cantilever showing the trolley approximately halfway between the horizontal and vertical position in accordance with an embodiment of the invention.

Referring now to FIG. 4G, a perspective view of the cantilever illustrates the trolley 245 approximately halfway between the horizontal and vertical position in accordance with an embodiment of the invention. FIG. 4G illustrates that the tubulars have been picked up and that there are no longer any tubulars in the trolley pick up area 240. Once the trolley 245 is clear of the trolley pick up area 240, another set of tubular stands may be placed in the trolley pick up area 240 either by using the deck or rig crane 205 or manually moving the stands to place them in the cut-out of the push-up arms 435.

Figure 4H:
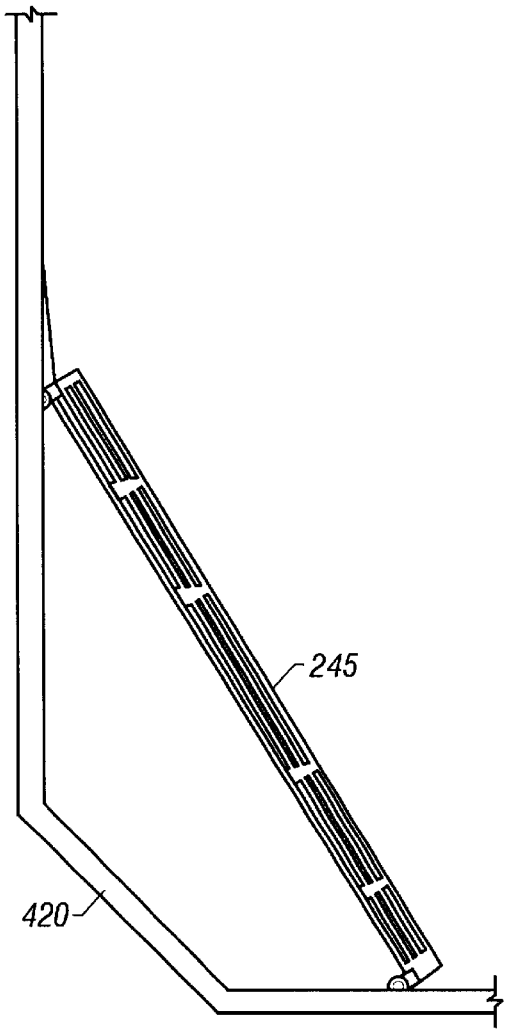
FIGS. 4H and 4I are side views of the trolley and the track in accordance with an embodiment of the invention.
Figure 4I:
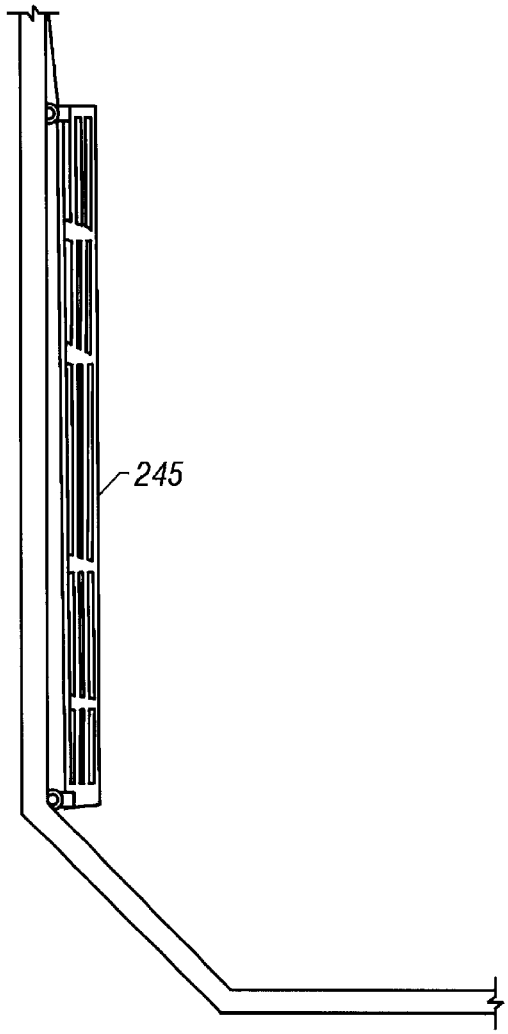

Referring now to FIGS. 4H and 4I, side views of the trolley 245 and the track 420 in accordance with an embodiment of the invention are illustrated. FIG. 4H shows the trolley in transit between the horizontal and vertical positions. FIG. 4I shows the trolley in a vertical position ready for the tubular stands to be removed from the trolley by a vertical pipe racking machine.

Figure 5A:
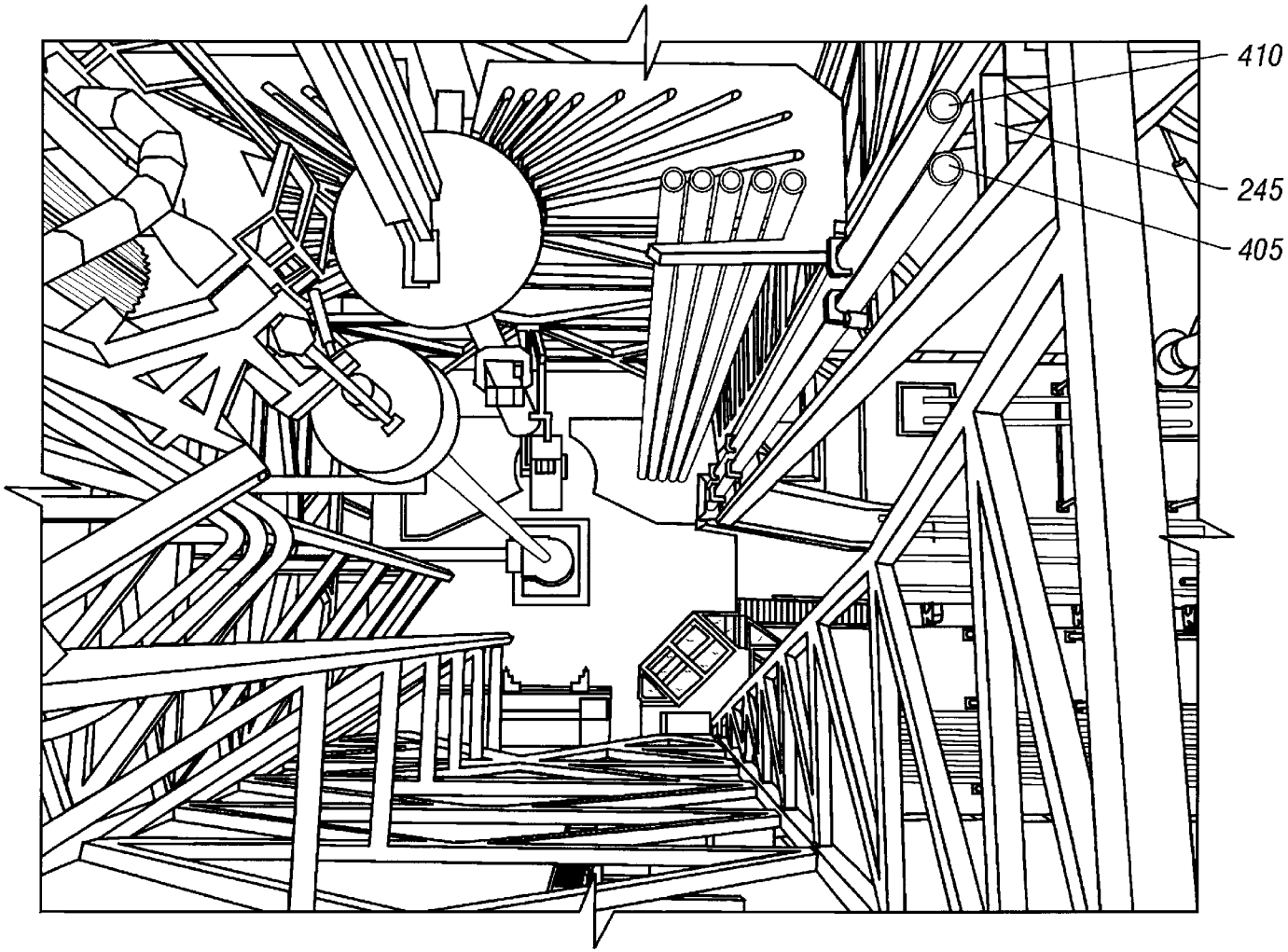
FIGS. 5A, 5B, 5C and 5D, are top perspective views showing the inside of the derrick in accordance with an embodiment of the invention.
Figure 5B:
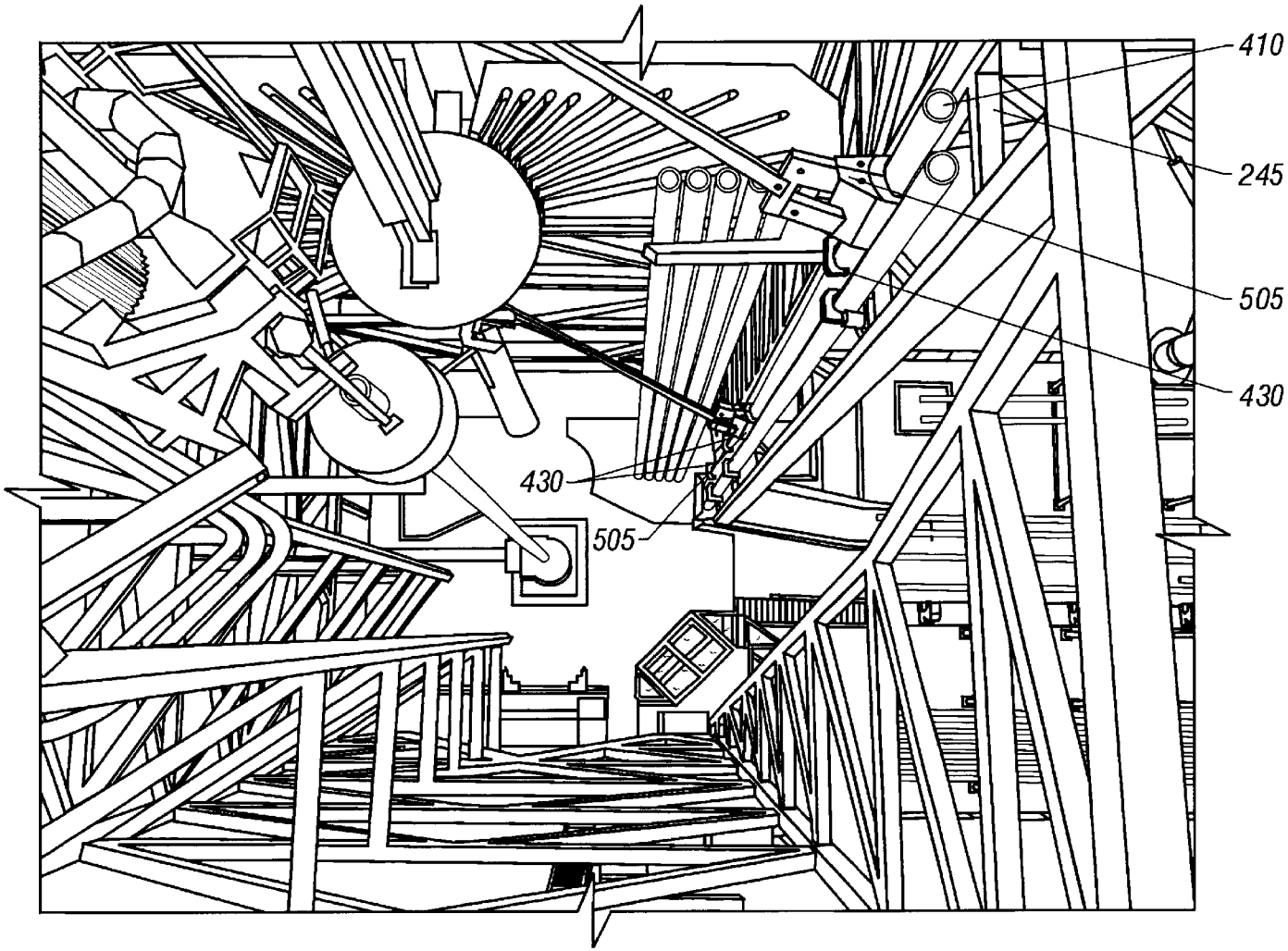

Referring now to FIGS. 5A, 5B, 5C, and 5D, top perspective views inside the box derrick 180 in accordance with an embodiment of the invention are illustrated. FIG. 5A shows the trolley in a vertical position before the tubular stands 405, 410 are released from the trolley 245. FIG. 5B shows a vertical pipe racking machine 505 as it attaches to the tubular 410 before the fingers 430 are released and retracted by the trolley 245.

Figure 5C:
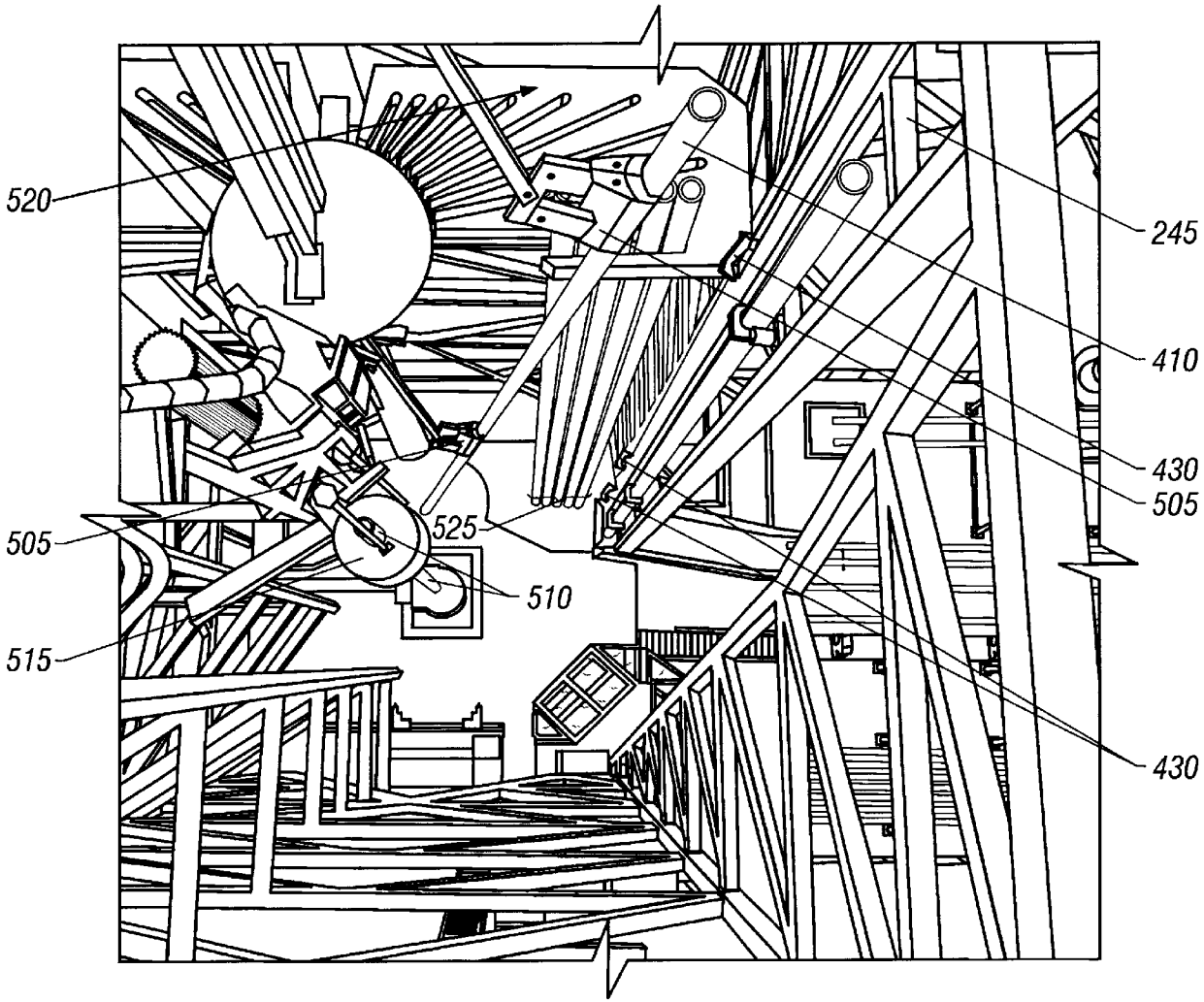

FIG. 5C shows the fingers 430 in a retracted position and the tubular stand 410 in transit between the trolley 245 and the well center. Provided that the prior tubular 510 has been run into the well far enough, the tubular 410 may be attached to the prior tubular 510 with traveling equipment 515, as is commonly known in the art, so that it may also be run into the well. However, if drilling is slow and the prior tubular 510 is not low enough for the tubular stand 410 to be installed at the time that the vertical pipe racking machine 505 removes the tubular stand 410 from the trolley 245, then the vertical pipe racking machine 505 can instead place the tubular stand 410 on the vertical pipe rack 520 in one of the slots shown. In this manner, a number of tubulars stands 525 can be held in the vertical pipe rack 520 for use in the event that the horizontal to vertical tubular transfer system malfunctions or is delayed for whatever reason. Thus, the horizontal to vertical transport system is kept out of the critical path of the operation except when it is in a vertical position at the rig floor entry. This system provides a more efficient and faster tubular handling operation then has been available in the past.

Figure 5D:
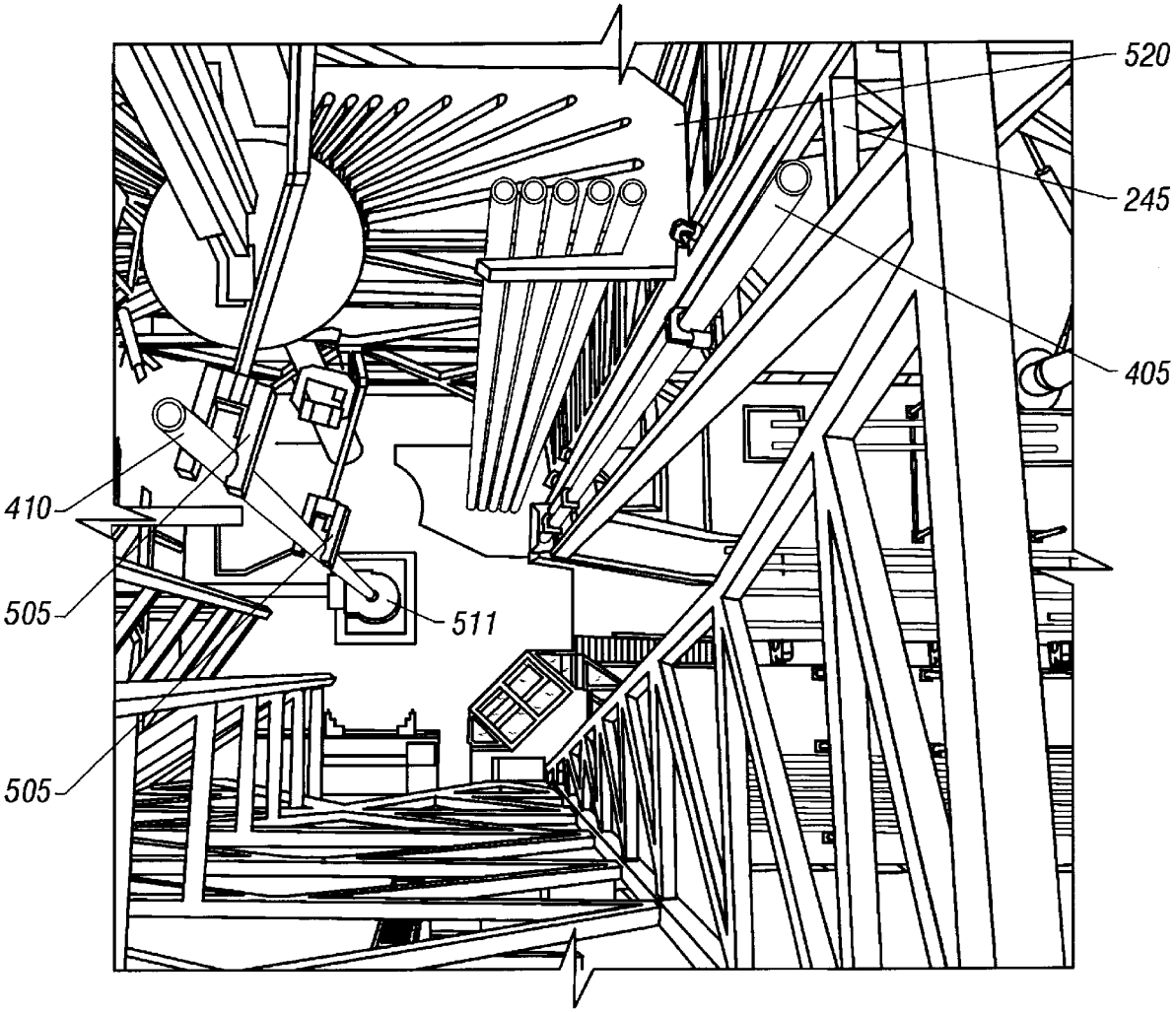

FIG. 5D shows the tubular stand 410 in a vertical position over the well center. Once the tubular stand 410 is screwed into the previous stand and torqued to the appropriate value by the tubular tong equipment 511, the vertical pipe racking system then retrieves the tubular stand 405 from the trolley 245 and either places it in a position so that it can be run into the well or places it in the vertical pipe rack 520 if the drilling operation is not ready for an additional tubular stand. Once the tubular stand 405 is removed, the trolley 245 can then be transported back down to the horizontal position by unwinding the cable winch 450 attached to the top of the trolley 245 to allow the trolley 245 to roll back down into the horizontal position. The operation can then be repeated with another set of stands. One with skill in the art with understand that the operation described above can simply be reversed to remove stands from the hole and break them out on the platform in a horizontal position using the breakout machine 250. This system significantly speeds up the process.

Figure 6:
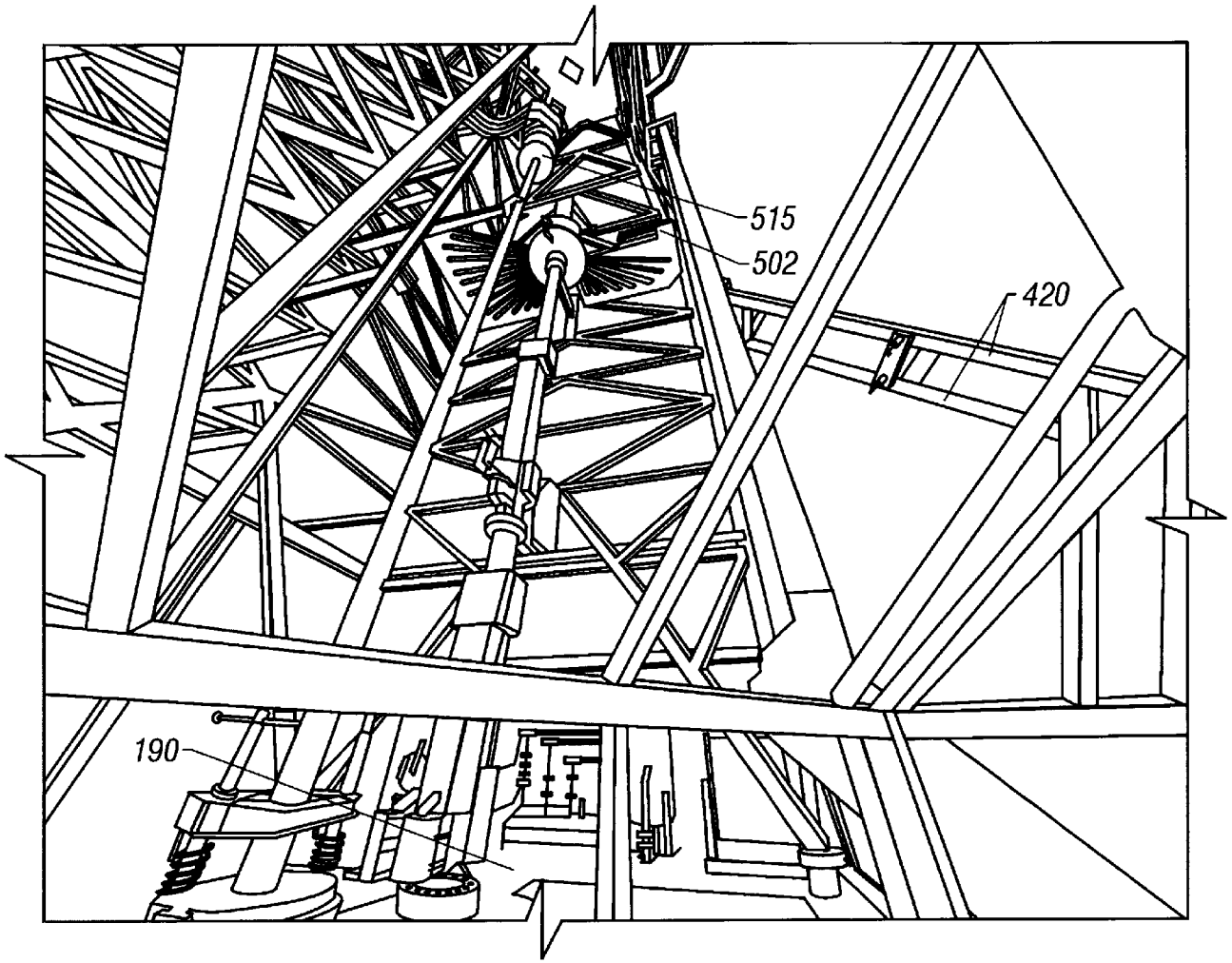
FIG. 6 is a bottom perspective view showing the inside of the derrick in accordance with an embodiment of the invention.

Referring now to FIG. 6, a bottom perspective view inside the box derrick 180 in accordance with an embodiment of the invention is illustrated. FIG. 6 shows the drill floor 190 as well as the tracks 420 on which the trolley 245 moves up and down between the horizontal and vertical position. The vertical pipe racking system 502 and traveling equipment 515 are also illustrated.

Those skilled in the art should understand that the previously described embodiments of the tubular transfer system are submitted for illustrative purposes only and other embodiments thereof are well within the scope and spirit of the present invention. Although the present invention has been described in detail, those skilled in the art should understand that they can make various changes, substitutions and alterations herein without departing from the spirit and scope of the invention in its broadest form. For example, changes to the design of the trolley and pick-up mechanism can be made. Other types of tubulars than those disclosed could also be used. Further, the pipe handling means inside the box derrick may also be varied without departing from the scope of the invention.

What is claimed is:

1. An apparatus for transferring a tubular stand between a substantially horizontal position and a substantially vertical position, said apparatus comprising:

a trolley adapted for grasping and transporting said tubular stand between said substantially horizontal position and said substantially vertical position. wherein said tubular stand comprises at least two tubulars connected to each other;

a track for guiding said trolley between said substantially horizontal position and said substantially vertical position; and a drive means for applying a force to move said trolley between said substantially horizontal position and said substantially vertical position.

2. The apparatus of claim 1 wherein said said apparatus further comprising a bucking machine for making up and breaking out said tubular stand in said substantially horizontal position.

3. The apparatus of claim 1 wherein said drive means comprises a cable winch with a cable attached to an upper end of said trolley for winching said trolley from said substantially horizontal position to said substantially vertical position such that said cable winch may be released to allow said trolley to travel back down said track to said substantially horizontal position.

4. The apparatus of claim 1 wherein said trolley comprises a first pair of wheels attached adjacent to an upper end of said trolley and a second pair of wheels attached adjacent to a lower end of said trolley such that said first pair of wheels and said second pair of wheels are adapted to travel along said track in response to said force being applied by said drive means.

5. The apparatus of claim 1 wherein said trolley comprises a plurality of fingers for grasping said tubular stand.

6. The apparatus of claim 1 wherein said substantially horizontal position is located over a deck and wherein said substantially vertical position is located at a rig floor entry.

7. The apparatus of claim 1 further comprising a plurality of push-up arms located at a pick-up area for pushing said tubular stand into said trolley such that a plurality of fingers on said trolley can grasp said tubular stand to hold said tubular stand in place on said trolley.

8. The apparatus of claim 1, wherein said tubular stand comprises three tubulars connected to each other.

9. A drill rig having a derrick and a platform attached adjacent to said derrick wherein said platform comprises a first horizontal pipe rack for storing a plurality of made-up stands and a second horizontal pipe rack for storing a plurality of individual tubulars, said drill rig comprising:

a trolley for transferring at least one made-up stand that comprises at least two tubulars, between a substantially horizontal position at a pick-up area on said platform and a substantially vertical position at a rig floor entry in said derrick; and a track for guiding said trolley between said substantially horizontal position and said substantially vertical position.

10. The drill rig of claim 9 further comprising a bucking machine horizontally situated on said platform for making-up and breaking-out said plurality of stands.

11. The drill rig of claim/further comprising:

a vertical pipe handling machine located in said derrick for retrieving said at least one stand from said trolley while said trolley is in said substantially vertical position; and traveling equipment for receiving said at least one stand from said vertical pipe handling machine and running said at least one stand into a hole.

12. The drill rig of claim 9 further comprising drive means for applying a force to said trolley to move said trolley between said substantially horizontal position and said substantially vertical position.

13. The drill rig of claim 12 wherein said drive means comprises a cable winch.

14. The drill rig of claim 9, wherein said made-up stand comprises three tubulars connected to each other.

15. A method for transferring a tubulars between a substantially horizontal position on a platform and a substantially vertical position at a rig floor entry, said method comprising the steps:

grasping a stand of tubulars comprising at least two connected tubulars in said substantially horizontal position using a trolley;

transporting said trolley with said tubular from said substantially horizontal position to said substantially vertical position; and removing said stand of tubulars from said trolley such that said tubular can be run into a hole.

16. The method of claim 15 wherein said trolley is transported along a track that guides said trolley between said substantially horizontal position and said substantially vertical position.

17. The method of claim 16 wherein said step of transporting is performed using a drive means for applying a force to said trolley to move said trolley between said substantially horizontal position and said substantially vertical position.

18. The method of claim wherein said step of removing is performed using a vertical pipe handling machine.

19. The method of claim 15, further comprising the steps:

making-up a plurality of stands on said platform prior to a drilling operation;

storing said plurality of stands in a horizontal pipe rack on said platform; and moving at least one stand from said horizontal pipe rack to a pick-up area where said step of grasping can be performed when said trolley is lowered to said substantially horizontal position.

20. A method for performing a drilling operation, said method comprising the steps:

transferring a plurality of individual tubulars to a platform;

preparing a first tubular and a second tubular for make-up;

making-up a stand in a substantially horizontal position on said platform using said first tubular and said second tubular;

grasping said stand in said substantially horizontal position using a trolley;

transporting said trolley with said stand from said substantially horizontal position to a substantially vertical position at a rig floor entry;

removing said stand from said trolley to a traveling equipment using a vertical pipe handling machine; and running said stand into a hole using said traveling equipment.

21. The method of claim 20 wherein after said drilling operation is completed, said method further comprising the steps:

removing said stand from said hole using said traveling equipment;

placing said stand into said substantially vertical position in said trolley;

lowering said trolley to said substantially horizontal position on said platform;

releasing said stand into said pick-up area;

raising said trolley back to said substantially vertical position; and breaking out said stand in said substantially horizontal position.

22. The method of claim 20 wherein said step of making-up is performed using a bucking machine situated in a horizontal position on said platform.

* * * * *

UNITED STATES PATENT AND TRADEMARK OFFICE

CERTIFICATE OF CORRECTION

PATENT NO. : 6,705,414 B2
DATED : March 16, 2004
INVENTOR(S) : Michael Simpson et al.

It is certified that error appears in the above-identified patent and that said Letters Patent is hereby corrected as shown below:

Column 4,
Line 60, after "in the derrick 180", please delete "in".

Column 6,
Line 43, after "In this manner, a number of", please change "tubulars" to -- tubular --.
Line 65, after "One with skill in the art", please change "with" to -- will --.

Column 7,
Line 40, after "The apparatus of claim 1 wherein said", please delete "said".

Column 8,
Line 19, after "The drill rig of", please change "claim/further" to -- claim 10 further --.
Line 35, after "A method for transferering" , please delete "a".
Line 56, please change "18. The method of claim wherein" to read -- 18. The method of claim 15 wherein --.

Signed and Sealed this

Eighth Day of February, 2005

JON W. DUDAS
*Director of the United States Patent and Trademark Office*